United States Patent [19]

Barringer

[11] Patent Number: 4,572,511

[45] Date of Patent: Feb. 25, 1986

[54] TUG-OF-WAR GAME

[76] Inventor: Jack E. Barringer, 1315 Big Blue Stem Ct., Ames, Iowa 50011

[21] Appl. No.: 657,756

[22] Filed: Oct. 3, 1984

[51] Int. Cl.[4] ..... A63B 21/28; A63B 69/00

[52] U.S. Cl. ..... 273/1 GC; 273/1 GH; 272/902

[58] Field of Search ..... 273/1 GH, 1 GI, 1 GC; 73/379-381; 272/901, 902, DIG. 5

[56] References Cited

U.S. PATENT DOCUMENTS 2,526,495 10/1950 Meyer ..... 73/380

2,934,342 4/1960 Tenney ..... 273/1 GH

*Primary Examiner*—Paul E. Shapiro

*Attorney, Agent, or Firm*—Henderson & Sturm

[57] ABSTRACT

This invention comprises a tug-of-war game having a drum rotatably mounted on a stationary frame, with an elongated rope wrapped about the drum with free ends extended to opposite sides of the drum, with pull on one free end rotating the drum in one direction and pull on the other free end rotating the drum in another direction, and with a scoreboard visibly responsive to which direction the drum is being rotated.

5 Claims, 9 Drawing Figures

TUG-OF-WAR GAME

TECHNICAL FIELD

The present invention relates generally to an apparatus used for playing a game, and more particularly to an apparatus comprising a rope wrapped around a rotatable drum, wherein contestants on both sides of the drum may pull on a portion of the rope on their side of the drum to try to pull the opposite contestants toward them so as to win the game, a scoreboard device visibly indicating the game during all stages of the pulling contest.

BACKGROUND ART

The conventional tug-of-war game is probably one of the oldest games known to mankind, for it requires only participants, a length of rope, and a relatively level playing field to ensure fairness. At the beginning of the game, the rope is laid out such that its midpoint is centered over an identifiable finish line or object, this leaving equal lengths or portions of rope on either side of the finish line. An equal number of contestants line up along the rope on each side of the finish line, usually grasping the rope but with its midpoint still centered. When the signal to begin the game is sounded, each side attempts to pull the other side over the finish side, and when that is accomplished, the game is won, and over. Various modifications may occur in the rules of the game, but the foregoing gives the reader the sense of the game.

A problem with the old-fashioned style of game is that it requires a great deal of room as the contestants tend to wander all over the place; although the contestants initially pull at right angles or normal to the finish line, their direction of pull varies rather wildly at times, and it is very difficult for the spectators to tell exactly which side is winning and by how much.

DISCLOSURE OF THE INVENTION

The above problems are substantially resolved, without undue compromise of other desirable attributes that are already provided by the prior art, by the provision of the invention disclosed herein.

The present invention relates generally to an apparatus used for playing a game, and more particularly to an apparatus comprising a rope device which is wrapped around a drum, the drum being rotatably mounted on a frame normally resting on a flat surface, wherein one or more contestants on each side of the drum pull on a portion of the rope on each respective side of the frame, the drum rotating according to the drum and letting out or wrapping up the rope according to which contestants are pulling the hardest away from the drum. The pulling lengths of the rope portions are continuously visibly displayed on a scoreboard assembly associated with the drum such that spectators can readily see which side is winning by viewing a display which indicates not only which side is winning but by how much.

The scoreboard assembly is shaped in the form of a person having raised arms stretching outwardly from the torso, which arms show incremental panels of different colored material from the shoulders to the hands. Behind the torso, head and arms are light elements which are electrically connected to the drum, such that as the drum rotates in one direction certain lights are energized to light up the panel(s) in front thereof, this visibly indicating to the audience, and even the contestants, the current status of the game.

BRIEF DESCRIPTION OF THE DRAWINGS

These and other attributes of the invention will become more clear upon a thorough study and review of the following detailed description of the best mode for carrying out the invention, particularly when reviewed in conjunction with the drawings, wherein.

BEST MODE FOR CARRYING OUT THE INVENTION

Figure 1:
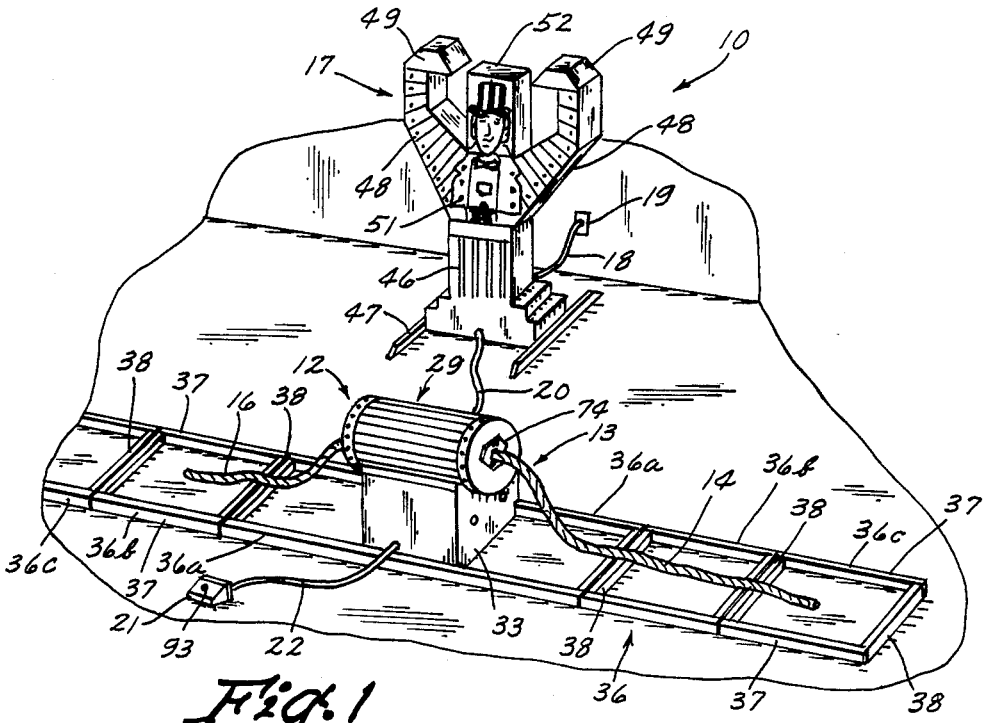
FIG. 1 comprises a perspective view of the tug-of-war game.

Referring now to the drawings, and in particular to FIG. 1, the tug-of-war game may be seen as depicted generally by the numeral (10). More specifically the game (10) comprises a drum (11) (FIGS. 3 and 4) rotatably mounted on a frame assembly (12), and about which is wrapped elongated unit (13), i.e., a rope having a first portion (14) and a second portion (16) extended to each respective side of the frame assembly (12) as best seen in FIG. 1.

To record and visibly indicate to contestants and spectators alike the status of the game, a display unit (17) (FIGS. 1 and 2) or scoreboard is provided, the scoreboard (17) having a lighting and sound circuit described in more detail hereinafter, connected by an electric cord (18) to a wall plug (19) for receiving standard 115 volt housecurrent, current being supplied to a selector switch (25) (FIGS. 5 and 8) mounted on one end of the drum (11), by cord (20) and to a manual control box (21) (FIG. 1) by another cord (22).

The drum (11) comprises a circular core (23) (FIGS. 3 and 5) affixed between a pair of flat, circular discs (24) of a larger diameter than the core (23) in order to provide shoulders about the core (23) so as to contain the rope portions (14) and (16) as they are wound and unwound about the core (23). A pair of axially aligned stub shafts (26) are affixed to the outer sides of the discs (24) at their centers and are mounted in bearings (27) mounted to a bracket (28) on the frame assembly (12).

Figure 3:
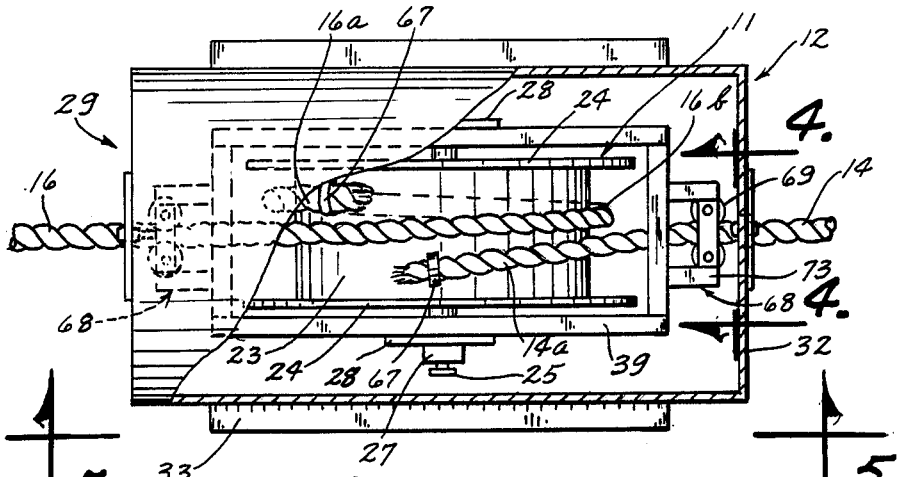
FIG. 3 comprises an enlarged top plan view, partly broken away, of the drum, rope and frame elements of the game.
Figure 5:
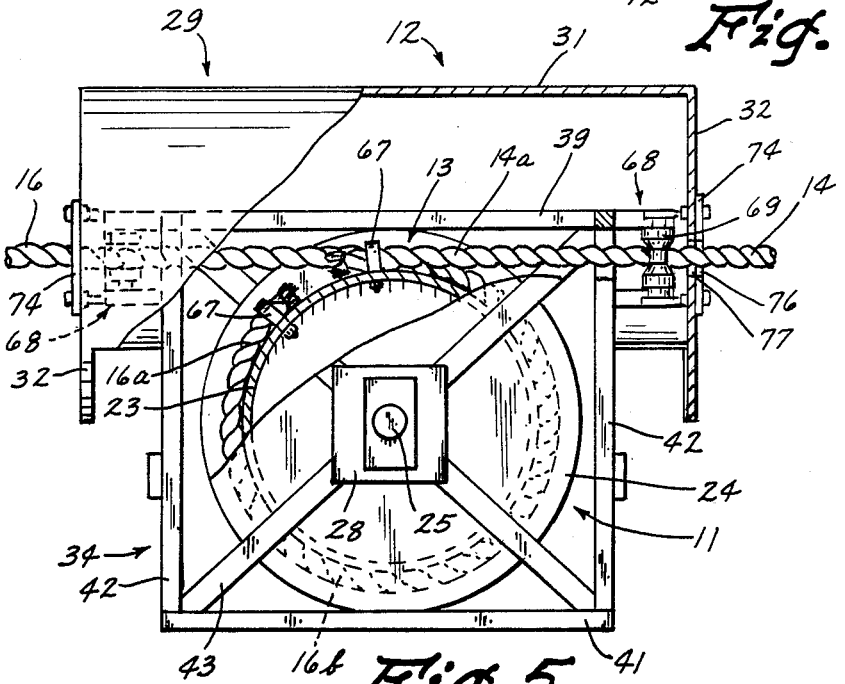
FIG. 5 is a vertical sectional view taken along the line 5—5 in FIG. 3.

The frame assembly (12) comprises a barrel-shaped upper housing (29) (FIGS. 1 and 5) with a curved top (31) and vertical ends (32) mounted on a rectangular housing (33) for the drum support structure indicated generally in FIGS. 3 and 5 at (34). The housing (33) is mounted upon an elongated rectangular track unit (36) (FIG. 1) having side rails (37) and equadistantly spaced foot boards (38), the boards (38) extended normal or at right angles to the rope portions (14) and (16). Further, the foot boards (38) extend parallel to the axis of rotation of the drum (11). The combination of side rails (37) and foot boards (38) may be comprised of sections, such as track unit sections (36*a*), (36*b*) and (36*c*) on each side of the frame assembly (12), which sections are connectable together to provide an adjustable length track unit (36).

The drum support structure (34) includes top and bottom rectangular frames (39) and (41), respectively, (FIGS. 3 and 5) of a size smaller than the housing (33) (FIG. 3) so as to fit therein; and which frames (39) and (41) are interconnected by side frames (42) braced by cross members (43) to which a bracket (28) is connected on each side of the structure (34).

Figure 4:
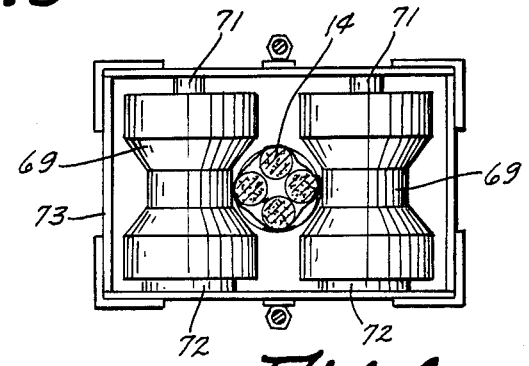
FIG. 4 comprises a further enlarged sectional view taken along the line 4—4 of FIG. 3 of a roller unit for guiding the rope portions.

As best illustrated in FIGS. 3–5, the rope portion (14) has its inner end (14*a*) secured to the periphery of the drum core (23) by a fastener (67), and the inner end (16*a*) of the rope portion (16) is fastened closely to the end (14*a*) by another fastener (67), but on the opposite side of the drum core periphery to avoid doubling over of the rope. As illustrated, the rope portion (14) is shown extended from the drum (11) its entire length to approximately the middle of the outer track section (36*c*); whereas the rope portion (16) is shown wrapped around the drum core (23) as much as provided for, portion (16*b*) shown, such that the rope portion (16) extends to approximately the middle track section (36*b*) on the left end of the frame assembly (12) as viewed in FIG. 1.

The rope portions (14) and (16) are each trained through a guide unit (68) (FIGS. 3–5) mounted on opposite upper sides (42) of the drum support (34). Each guide unit (68) is identical to the other and includes a pair of hard rubber rollers (69) (FIG. 4) mounted by rods (71) and washers (72) to a box frame (73) in spaced relation so as to rotatably receive and guide a respective portion (14) or (16) of the rope unit (13). It will be noted in FIG. 5 the guide units are mounted such that the rope portions are guided off the upper periphery of the drum core (23) in a horizontal plane therewith. Fastener plates (74) with rope openings (76) (FIG. 5) formed therein are affixed over openings (77) formed in the barrel ends (32) to strengthen the ends (32) so as to withstand the tugging forces on the ends (32) from the rope portions during the contests.

To provide a visible display or scoreboard (17), a plywood or like base (46) (FIG. 1) mounted on skids (47) supports a pair of arms (48) (FIGS. 1 and 6) and hands (49) extended upwardly and outwardly from a torso (51) and head unit (52). The front of the display has numerous indicia including a face and hat (54), a READY tie (56), a SET clasp (57), a TUG buckle (58) flanked by a pair of EVEN emblems (59), a plurality of alternating blank and colored stripes (62) and (63), respectively and TUGGER hands indicia (64).

To mount the panel (53) on the remainder of the display (17), the panel (53) is provided with magnetic strips (not shown) around its periphery, which strips mate with peripheral metal strips (66) (FIG. 6) attached to the front of the plywood frame for the torso (51), arms (48) and hands (49). The head unit (52) may be box shaped so as to rest upon the torso (51) and be easily removable, as is the case with the indicia panel (53), for maintenance purposes.

Figure 2:
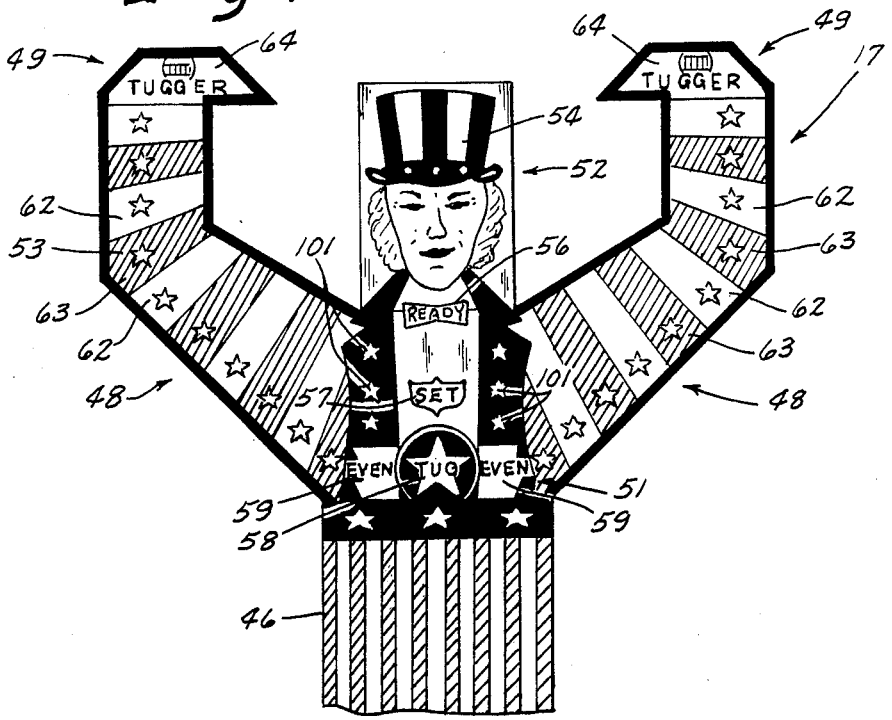
FIG. 2 comprises an enlarged front elevational partial view of the display.
Figure 6:
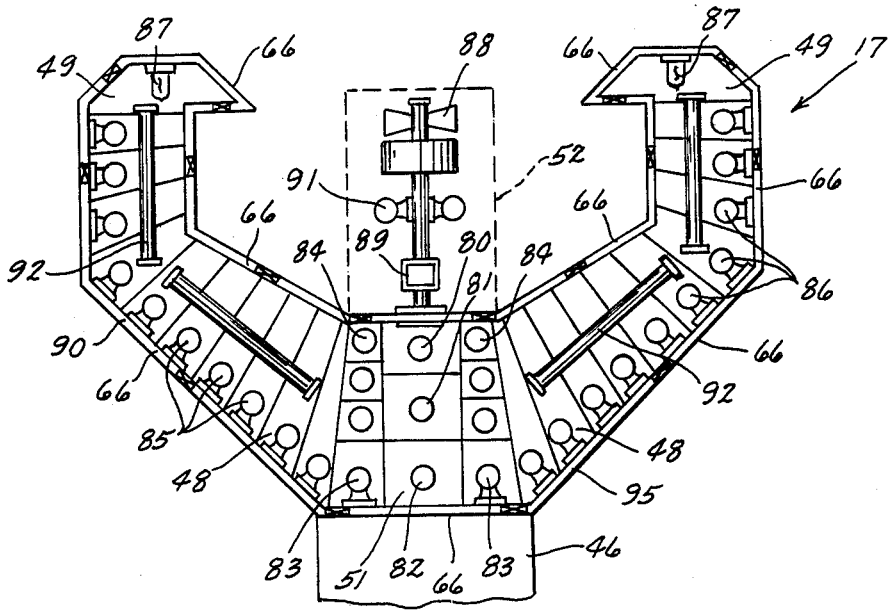
FIG. 6 is a view comparable to FIG. 2, but with the display panel removed to show the interior lighting arrangement of the display.

Turning to the lighting support built into the display unit (13), and comparing FIG. 6 with FIG. 2, the indicia panel (53) of the display unit having been removed from the structure of FIG. 2 to expose the inner lighting arrangement of the display unit (13), the following electrical units are provided: a READY incandescent bulb (80) (not all conventional bulb mounting sockets are shown), a SET bulb (81), a TUG bulb (82), a pair of EVEN bulbs (83), a trio of foul bulbs (84) located on opposite sides of the READY, SET and TUG bulbs, a plurality of game status or scoring bulbs (85) mounted in spaced relation on the outer wall (90) of the left arm as viewed, a like plurality of status or scoring bulbs (86) mounted in like spaced relation on the outer wall (95) of the right arm as viewed, a strobe (87) mounted in each hand (49), a rotating beacon unit (88) mounted on the torso (51), and a buzzer unit (89) mounted in connection with the beacon unit (88). The display unit (13) (FIG. 6) includes further bulbs (91) and fluorescent bulbs (92) mounted at appropriate locations within the unit (13) for background lighting purposes.

Figure 7:
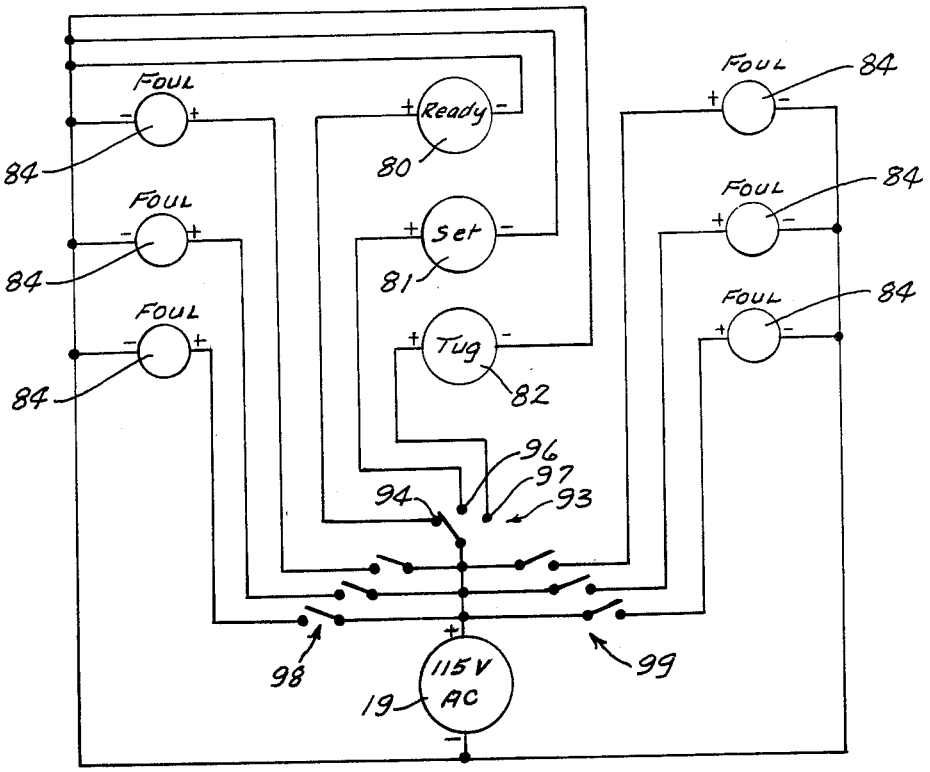
FIG. 7 is an electric schematic of the control unit for the game and certain lighting units controlled thereby in the display.

FIG. 7 illustrates the manual control circuit such that a person may initiate and control the game, according to the rules as built into the game, and of the house. The control box (21) (FIG. 1) is adapted to be hand held and has a manually operated threeposition rotary switch (93) connected via the electrically connected cords (22) and (20) to the source current (19). As illustrated, the switch (93) may close the circuit to either of the contacts (94), (96) or (97) to illuminate the desired bulb and light up the desired indicia of READY (56), SET (57) or TUG (58) (FIG. 2). Sets of manual switches (98) and (99), normally open, are provided to enable the "umpire" operating the control box (21) to illuminate the respective left and right, as viewed, banks of foul bulbs (84) and indicia (101) (FIG. 2). The control circuit of FIG. 7 is otherwise conventional.

Figure 8:
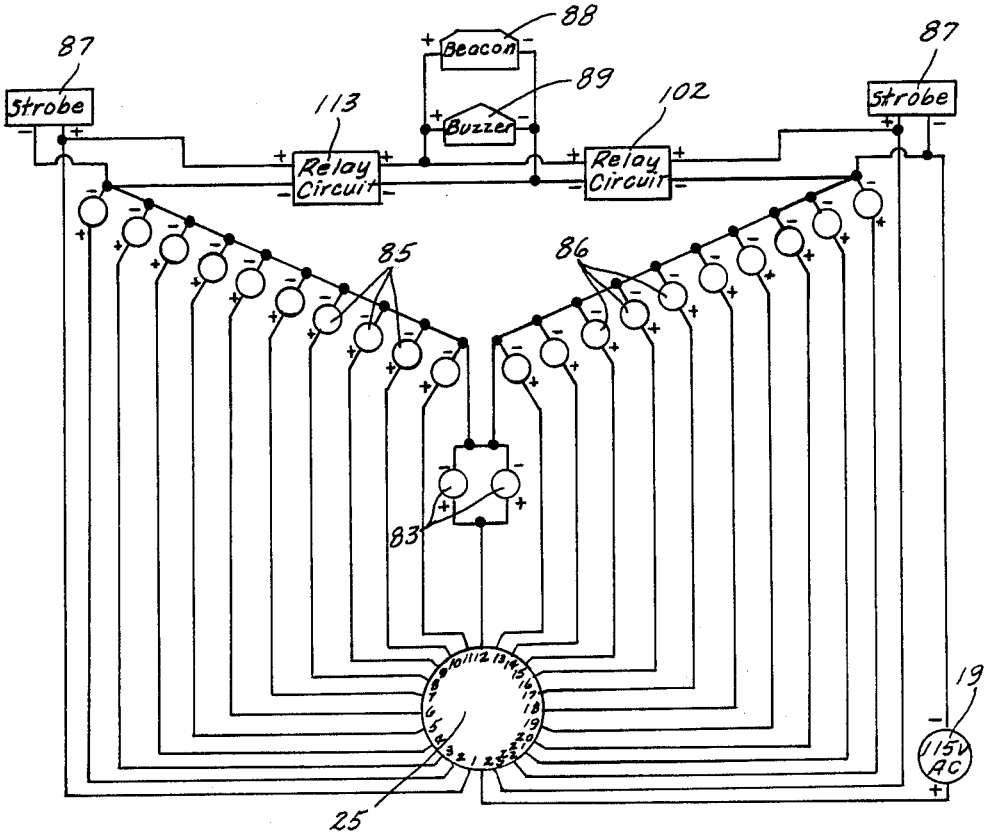
FIG. 8 is an electric schematic of the drum selector switch unit and certain display lighting elements controlled thereby.

To indicate visibly, and audibly if desired, the status of score-if you will, of the tug-of-war game as it is progressing, the rotary selector switch (25) mounted on the drum (11) has a plurality of contacts, twenty three in number in this instance, as indicated in FIG. 8. The switch (25) may be either single or double stage, applicant preferring a commercially available two-stage switch for reliability purposes. With the rope portions (14) and (16) extended at even lengths from the drum (11) at the beginning of the game, contact #12 is closed such that the EVEN bulbs (83) are lighted, whereby the umpire can then energize the READY, SET and TUG bulbs (80), (81) and (82), respectively, and the game begins.

Should the team on the right side of the drum (11) (FIG. 1) start pulling the rope portion (14) outwardly of the frame (13), whereby the drum (11) is rotated clockwise as viewed in FIG. 5 and more of the rope portion (16) is wrapped about the drum (11), the selector switch (25) (FIG. 8) also is rotated clockwise such that contacts #13, 14, 15 etc. are closed thereby transmitting current through the appropriate electrical lines to the respective bulbs (86) in sequential succession. If the left team, as viewed, then stands fast and begins overpowering the right team, the drum (11) rotation is reversed and as the left rope portion (16) is pulled outwardly through the left guide unit (68) (FIG. 5), the right rope portion (14) is rotated inwardly and wrapped around the drum (11).

This action causes the selector switch (25) to reverse rotation, moving counterclockwise and thus contacts

#15, 14, 13, 12 and then 11, 10, 9 etc. are closed, the appropriate right and left banks of bulbs (86) and (85), respectively, lighting up sequentially. As one can envision, the spectators particularly, can view not only the pulling and straining of the contestants but also their relative pulling positions are visibly indicated on the display scoreboard at all times, giving more excitement to the game, and providing for more audible support from the spectators. The electrical elements and connections are conventional, the current flow being indicated.

When one team finally pulls the other team inwardly toward the frame (12) as much as is necessary to win, as where the rope portion (14) is completely pulled outwardly and away from the drum (11) (FIGS. 1 and 3), the selector switch (25) (FIG. 8) closes contact #23, and energizes the right strobe light (87) to illuminate the right hand (49) as viewed in FIG. 1, indicating that the right team has won. To further indicate the "win," a relay circuit (102) (FIG. 8) is activated to energize the visible beacon (88) and the audible buzzer (89).

Figure 9:
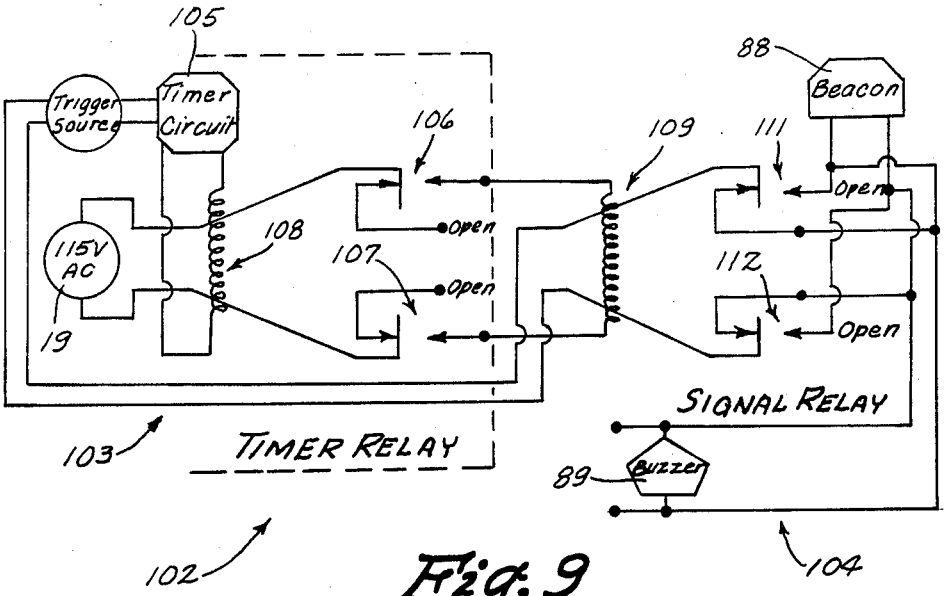
FIG. 9 is an electric schematic of the timer relay and signal relay circuits for the game.

Referring to FIG. 9, the relay circuit (102) comprises a conventional timer relay (103) and signal relay (104). The circuit is shown in its uncharged state. The "trigger source" refers to the two WIN positions, #1 and 23, on the rotary selector switch (25). When the switch (25) is rotated to a WIN position, current through the switch (25) simultaneously starts the timer (103) and provides power to the beacon (88) and buzzer (89). When first triggered, the timer (103) stays inactive, the switches (106) and (107) being normally open, until the preset time at the timer circuit (105) has elapsed, the solenoid (108) then closing the switches (106) and (107).

This action then activates the signal solenoid (109) which closes the normally open switches (111) and (112) thus energizing both the beacon (88) and the buzzer (89). When the timer circuit (105) is deactivated, discharging the solenoid (108), all elements return to their original positions. The circuit may provide for the beacon (88) to remain energized after the buzzer (89) has been turned off automatically. This circuit may easily be modified to accommodate the operator's desires. The left, as viewed, relay circuit (113) operates exactly as the right (102).

It is thus seen that a tug-of-war game apparatus is illustrated and described wherein by the combining of the conventional rope with a drum assembly and a display assembly, a unique and entertaining game is provided for both contestants and spectators.

Obviously, many modifications and variations of the present invention are possible in light of the above teachings. It is therefore to be understood that, within the scope of the appended Claims, the invention may be practiced otherwise than as specifically described.

I claim:

1. A tug-of-war game comprising:

(a) means rotatably mounted on a frame, said frame adapted to be stationary ;

(b) elongated means attached to said rotatable means and having one portion adapted to extend away from said rotatable means in one direction and a second portion adapted to extend away from said rotatable means in an opposite direction, said elongated means having a first condition wherein said portions are at midpoint relative to said movably mounted means, a second condition wherein the extension of said one portion is greater than the extension of said second portion, and a third condition wherein the extension of said second portion is greater than the extension of said one portion said rotatable means includes a single rotatable drum to which an inner end of each said portion is attached, and about which each said portion is wrapped upon rotation of said drum, said drum being rotatable in either direction more than 360° in response to either of said portions being pulled away from said drum at substantial right angles to the axis of rotation of said drum; and (c) means for responding visibly to each of said elongated means conditions.

2. The tug-of-war game of claim 1 wherein said elongated means comprises a rope trained about said drum, and with a pair of guide units mounted on said frame to guide said rope portions off of said drum such that said guided rope portions lie in common horizontally disposed plane.

3. The tug-of-war game of claim 1 wherein said visibly responsive means comprises a display unit having adjacent panels sequentially illuminated in a predetermined direction responsive to rotation of said rotatable means due to said elongated means being pulled in one or an opposite direction away from said frame.

4. The tug-of-war game of claim 3 wherein said display unit comprises a head, a torso and a pair of arms extended upwardly and outwardly of said torso, said arms and said rope portions adapted to be disposed parallel each other, respectively.

5. The tug-of-war game of claim 4 wherein said panels are transparent and formed on said arms, and lighting devices are mounted behind said panels, said drum having a rotary selector switch responsive to rotation of said drum for sequentially energizing said lighting devices, whereby as one rope portion is pulled outwardly away from said frame, lighting devices on said arm extended in the same direction as said one rope portion portion are sequentially lighted, beginning nearest the torso and outwardly on the arm until said arm is entirely lighted.

* * * * *